US007887390B2

(12) United States Patent
Dowe

(10) Patent No.: US 7,887,390 B2
(45) Date of Patent: Feb. 15, 2011

(54) REVERSIBLE BRA

(76) Inventor: Maxine M. Dowe, 619 Soders Rd., Apt. D-4, Penns Grove, NJ (US) 08069

( * ) Notice: Subject to any disclaimer, the term of this patent is extended or adjusted under 35 U.S.C. 154(b) by 467 days.

(21) Appl. No.: 12/129,818

(22) Filed: May 30, 2008

(65) Prior Publication Data

US 2010/0144241 A1 Jun. 10, 2010

(51) Int. Cl.
*A41C 3/00* (2006.01)

(52) U.S. Cl. ..... 450/91; 450/86; 450/58; 2/DIG. 2

(58) Field of Classification Search ..... 450/58, 450/17, 23, 26, 79, 82, 86, 88, 28, 91; 2/DIG. 2, 2/336, 338, 337, 340, 334, 321, 328, 301; 24/700–702
See application file for complete search history.

(56) References Cited

U.S. PATENT DOCUMENTS 1,936,378 A * 11/1933 Carr ..... 24/574.1
3,726,286 A 4/1973 Wolfson
4,939,823 A * 7/1990 Klein ..... 24/581.1
5,044,051 A * 9/1991 Klein ..... 24/581.1
5,180,326 A 1/1993 Williams
6,260,242 B1 * 7/2001 Fildan et al. ..... 24/329
6,260,243 B1 * 7/2001 Fildan et al. ..... 24/329
6,298,527 B1 * 10/2001 Fildan et al. ..... 24/689
6,442,808 B2 * 9/2002 Fildan et al. ..... 24/689
6,863,589 B2 3/2005 Cano
7,001,240 B1 2/2006 Huffman-Jimenez
7,238,081 B2 7/2007 Fildan et al.
7,435,156 B1 * 10/2008 Liu ..... 450/92

* cited by examiner

*Primary Examiner*—Gloria Hale
(74) *Attorney, Agent, or Firm*—John D. Gugliotta, PE, Esq

(57) ABSTRACT

And improved bra is provided having a each cup having a first fabric on a first side and a varying fabric on a reverse side. Each strap incorporates a pair of decorative pivoting claps and an attachment band incorporates a decorative magnetic reversible latch.

9 Claims, 5 Drawing Sheets

REVERSIBLE BRA

RELATED APPLICATIONS

None.

BACKGROUND OF THE INVENTION

1. Field of the Invention

The present invention relates generally to reversible garments and, more particularly, to a reversible undergarment having alternate aesthetic faces, in combination with a closure means that accommodates such dual use.

2. Description of the Related Art

Mary Phelps Jacob first invented a brassiere to replace a corset when she desired to wear a sheer evening gown to a social event. Her brassiere was patented in 1914, but it's design flattened a woman's chest. Bra technology advanced over the last century to lift, to position, to point and to mainly support breasts. Besides providing the foregoing utility, the bra is designed to be a fashion garment in and of itself or to compliment fashion attire worn over it. A plurality of bras are designed in forms of seamless, balconette, gels, padded, push-ups, water, etc. The average woman owns six bras of varying designs, but almost every woman owns at least a white one.

Bras can cost over $50 a piece because of a complexity of their designs. They fall apart easily in a wash, so a woman might wear a same bra four or five times before washing it. It is therefore undesirable for a person to purchase a bra specific to just one garment, s.a., e.g., a sheer blouse that is seldom worn. It is similarly undesirable for a woman to carry multiple bras when she anticipates a change of clothes in a course of a day. That woman requires a different bra if she changes into opaque fabrics. Bras are worn to support silhouettes, but they are worn distastefully when they mismatch opaque blouses. It is therefore desirable to teach a reversible bra having varied colors and designs on reverse sides. The bra is capable of supporting from either side; it is reversed to accommodate a desired outer attire.

A search of prior art reveals no patents that read directly on claims in the present invention; however, the following references are considered related:

U.S. Pat. No. 5,180,326, issued in the name of Williams, discloses a reversible mastectomy brassiere which may be worn soon after surgery is disclosed with the primary purpose of this brassiere concept being to provide a mastectomy brassiere which may position a prosthesis on the left breast, or when said brassiere is completely reversed, to position a prosthesis on the right breast of the mastectomy patient. This design further includes front fasteners which function equally well irrespective of the side on which the brassiere is worn. The brassiere will provide adequate coverage for the patient soon after surgery, without the necessity of an expensive and time consuming special fitting. The second important aspect of this design is its continuous unbroken and smooth appearance when worn because the brassiere configuration and all outer edges have no apparent sewing or standard finishing of any kind on the outer surface of the brassiere. This design blends smoothly with the body's contour and gives visual reassurance and psychological relief to the patient recovering from the trauma of surgery.

U.S. Pat. No. 3,726,286, issued in the name of Wolfson, discloses a brassiere in which each of the breast cups thereof includes inner and outer layers of material between which is defined an interior pocket. The pocket of each cup contains a stiffening means, preferably in the form of a generally U-shaped fabric enclosed underbust wire stay. Preferably, such stiffening means are secured for a major portion of their length to lower edge portions of the inner and outer layers of the breast cups which edge portions extend into the afore described pockets whereby each stiffening means is free to float with respect to the major surface area of the inner and outer layers of each breast cup. Minor portions of the lengths of each stiffening means are loosely joined to one another (through a fabric joining member) but are free to float within a passageway joining the interior pocket of each breast cup. In this manner, the brassiere of the invention is free to accommodate itself to the size and shape of the bust of the wearer rather than restraining the bust in the manner of a conventional wire bra. A horizontally seamed breast cup construction which eliminates the vertical center section of a typical wire bra further permits the bra of the invention to adopt itself to a woman's bust and provide in a wire bra the newer, soft, unaccentuated look.

U.S. Pat. No. 7,238,081, issued in the name of Fildan et al., discloses a reversible adjustable shoulder strap which can be used with high versatility in a variety of strap patterns, for a brassiere, has a strip formed with injection mold male and female closure members which can mate with one another and are identical on either side of the strip.

U.S. Pat. No. 6,260,242, issued in the name of Fildan et al., discloses a reversible press button closure for shoulder straps of brassieres or back band connectors has soft attachment pieces secured to the garment and connected by pins and lugs with male and female ring members which are molded from a harder plastic and define the press button assembly. The male and female members match in appearance when they are interconnected so that the connector has the same appearance from both sides.

U.S. Pat. No. 7,001,240, issued in the name of Huffman-Jimenez, discloses a brassiere for use by women having asymmetrical breasts which are not comfortably or properly received in and/or supported by the symmetrical breast cups as provided in the usual brassiere. The brassiere comprises a garment having a unitary body section which encircles the midriff of a woman with asymmetrical breasts, a closure for adjusting the body section of the brassiere to fit the midriff of the woman, and a pair of asymmetrical breast cups carried by the body section, the body section positioning the cups to comfortably and properly receive and support the woman's asymmetrical breasts. The brassiere may be turned inside-out to reverse orientation of the cups.

U.S. Pat. No. 6,863,589, issued in the name of Cano, discloses a tube brassiere that is formed from a circularly knitted garment blank. The blank has an internal dimension, a length, and a pair of breast cup defined therein. The length of the blank encircles a torso of a wearer.

Further, other unpatented designs are known to be commercially available. The Very Sexy® Secret Embrace™ reversible flip bra sold at Victoria's Secret is a demi-shaped, seamless, stitch free, under wire bra that can be worn on both sides to showcase a solid or a print. And, the Sealbeauty reversible flip bra manufactured by Guangzhou Huar Garment Company in China is a seamless, enclosed foam, under wire, double-sided wearable bra;

The present invention is a reversible bra having different prints on reverse sides that both can be worn. The present invention is distinct over the references because it teaches a novel clasp, wherein traditionally exposed, portions of a clasp are covered by a strap for a reverse clasp on the reverse side.

SUMMARY OF THE INVENTION

It is an object of the present invention to provide a reversible bra that supports and lifts from reverse sides.

It is an object that the reversible bra comprises two fabrics having different patterns, colors or aesthetic motifs.

It is an object that the reversible bra can be worn to compliment multiple outfits.

It is an object that the reversible bra comprise a novel clasp that comprises a means to cover excess portions of straps that would remain exposed.

It is envisioned that the reversible bra comprise two fabrics, each of which vary in color and/or design. A first of the two fabrics covers at least the cups on a front side and a second of the two is on a reverse. The reverse hugs the body when the front is shown, but the front hugs the body when the reverse is shown. An under wire is shared by the two fabrics to offer support. The two fabrics are independent such that they are both adjusted with their own clasp and their own shoulder straps; hence, the reversible bra may have a band for each side. When the corresponding parts are clasped for the side that is shown, the excess portion of the strap that makes up the band clasp portion is exposed; however, a clasping of the reverse clasp covers that exposed material such there is no exposed, unused strap.

BRIEF DESCRIPTION OF THE DRAWINGS

The advantages and the features of the present invention will become better understood with reference to the following more detailed description and claims taken in conjunction with the accompanying drawings, in which like elements are identified with like symbols, and in which:

FIG. 5A through 5D are perspective view of the steps for utilizing the pivoting clasp 100 used with the present invention;

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
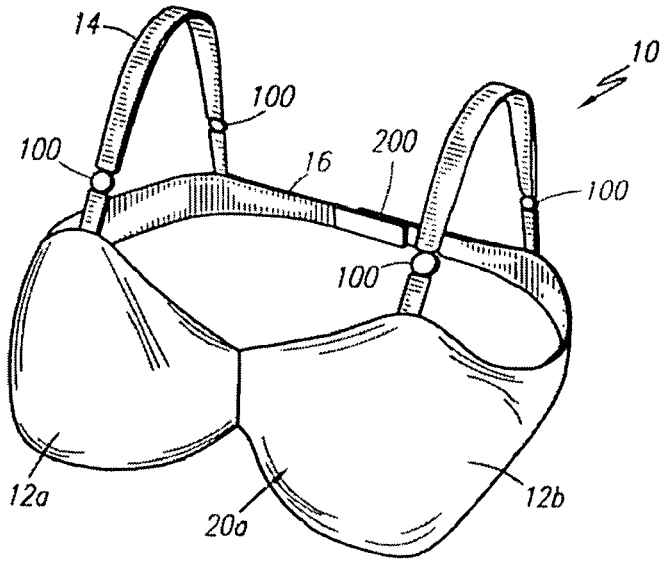
FIG. 1 is a front perspective view of a reversible bra according to a preferred embodiment of the present invention.
Figure 2:
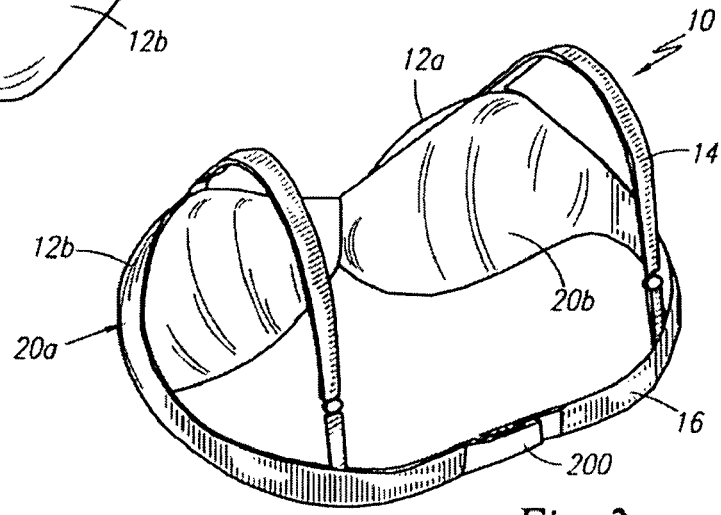
FIG. 2 is a rear perspective view thereof.
Figure 3:
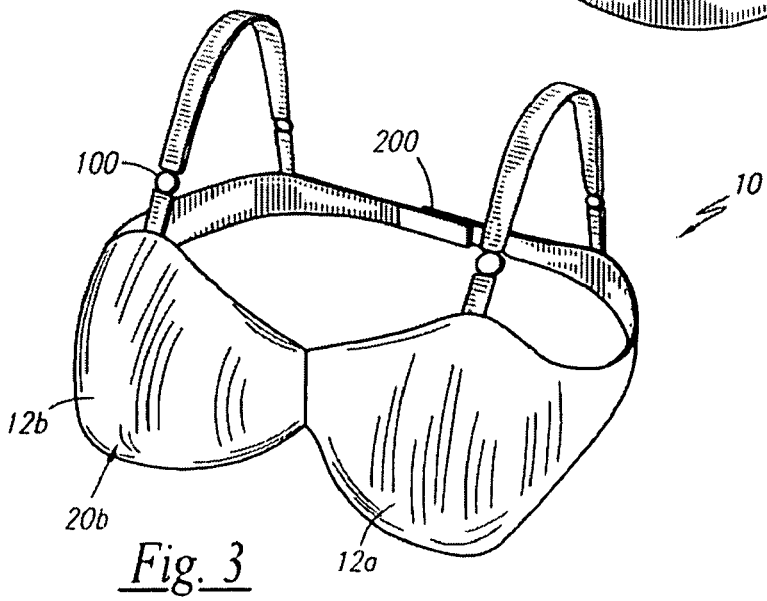
FIG. 3 is a front perspective view, wherein the bra is inverted about a user's midline.
Figure 4A:
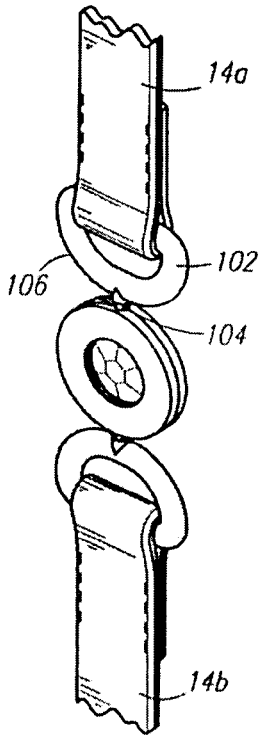
FIG. 4A is a detailed perspective view of a pivoting clasp 100 for use therewith.
Figure 4C:
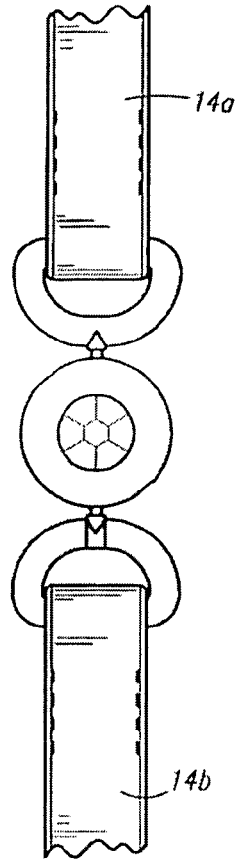
FIGS. 4C and 4D are front and rear elevational views thereof, respectively.
Figure 4B:
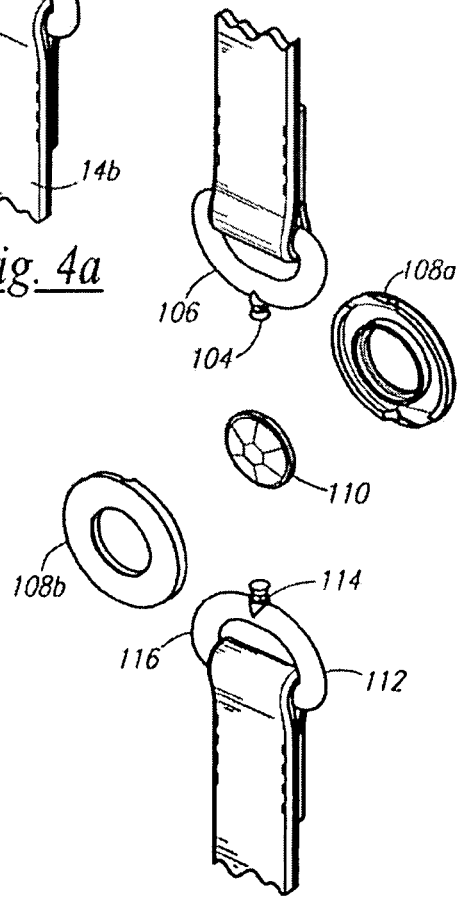
FIG. 4B is and exploded perspective view of the pivoting clasp 100 of FIG. 4B.
Figure 4D:
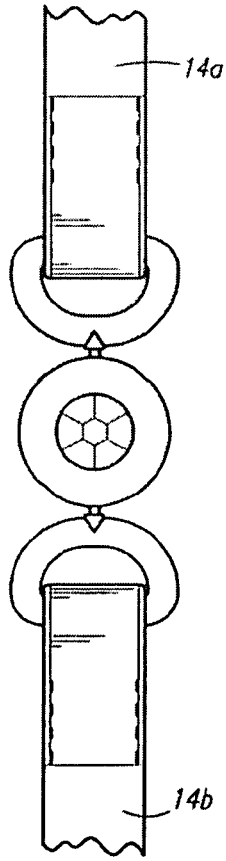

Referring to FIG. 1-3, a reversible bra 10 is shown according to a preferred embodiment of the present invention. The bra 10 comprises two cups 12*a*, 12*b*, adjustable shoulder straps 14 and a band 16 that is shown in a clasped position. The reversible bra 10 is inverted at a center to showcase a reverse side of a first 12*a* of the two cups. The reversible bra comprises a first fabric on a first side 20*a* and a varying fabric on a reverse side 20*b*. The fabrics vary is either or both of color and design. The fabrics may also vary on both sides, s.a., a silk on the first side 20*a* and a cotton on the second side 20*b*.

Each strap 14 incorporates a pair of decorative pivoting claps 100 described in greater detail below. Further, the band 16 incorporates a decorative reversible latch 200, also described in greater detail below.

Referring now to FIG. 4A through 4D, the pivoting clasp 100 is shown in greater detail in which the should strap 14 is separated into an upper strap element 14*a* and a lower strap element 14*b* connected by the pivoting clasp 100. The upper strap element 14*a* is terminated by a first D-ring connector 102 having a first pivot pin 104 extending downwardly from the apex of the connectors distal apex 106. An annular clasp body 108, formed of a first body half 108*a* and second body half 108*b*, mounts rotatably about the first pivot pin 104. Given the capacity of the present invention to provide two separate aesthetic appearances, it is envisioned that each body half 108*a*, 108*b* can be coordinated with a different color scheme. Further adding to an aesthetic, a bead, gem or charm 110 can be retained within the annular space of and by the respective clasp body 108. It is further anticipated that each body half 108*a*, 108*b* are either recessed, or preferably made of a soft, surface resilient material so as to be comfortable against the user's skin and not leave marks or abrasions.

Similarly, the lower strap element 14*b* is terminated by a second D-ring connector 112, similarly having a second pivot pin 114 extending upward from the apex of the connector's distal apex 116. The second pivot pin 114 is used to remove and rotate the straps 14 as will be described in greater detail below.

Referring now to FIG. 6A through 6E, the band 16 incorporates a decorative reversible latch 200 formed of interlocking first latch half 202A and second latch half 202B. As shown in conjunction with the exploded view of FIGS. 6C and 6D, each latch element 202 is formed of a linearly elongated fabric cover 210 having an aesthetic outer surface 212 and securing an interlocking attachment element 214 on the inner surface. The attachment element 214 is also linearly elongated, and forms a lateral series of detents 216 anticipated as being designed for symmetric, interlocking fitment with each other. A magnetic strip 220 is sandwiched between the fabric cover 210 and attachment element 214, and by configuring the orientation of the direction of magnetic pole of the respective strips 220 the first latch half 202A and second latch half 202B can be made in symmetric configurations that still magnetically attract and connect to one another. The use of various rare earth magnets for the strip 220 can provide differing levels of attachment force, as desired, while the interlocking detents 216 provide sufficient lateral interference to hold the strap in position.

2. Operation of the Preferred Embodiment

Figure 5A:
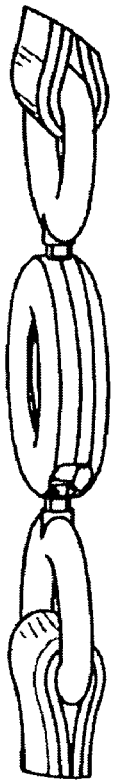
Figure 5A:
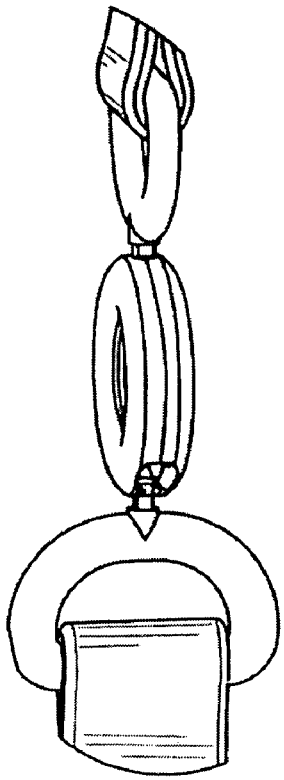
Figure 5C:
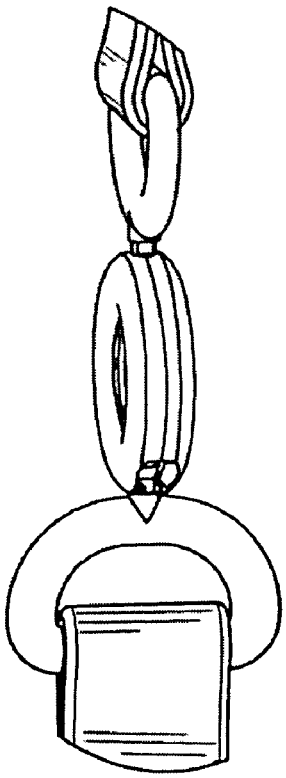
Figure 5D:
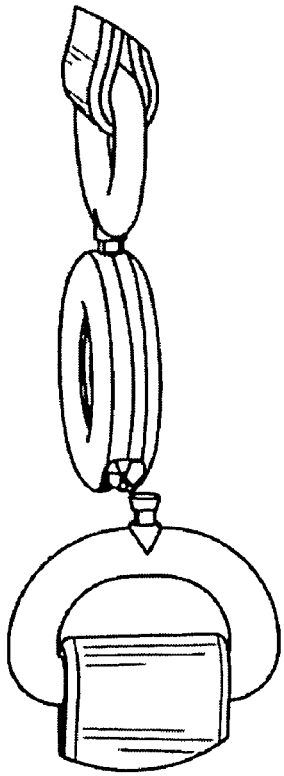
Figure 6A:
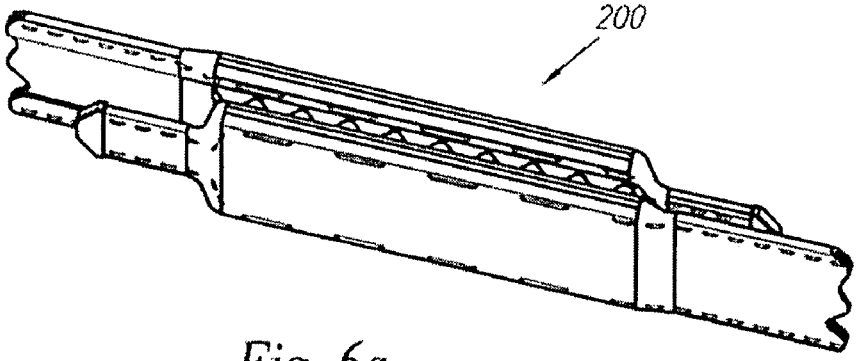
FIG. 6A through 6E are views of the decorative reversible latch 200 used with the present invention.
Figure 6B:
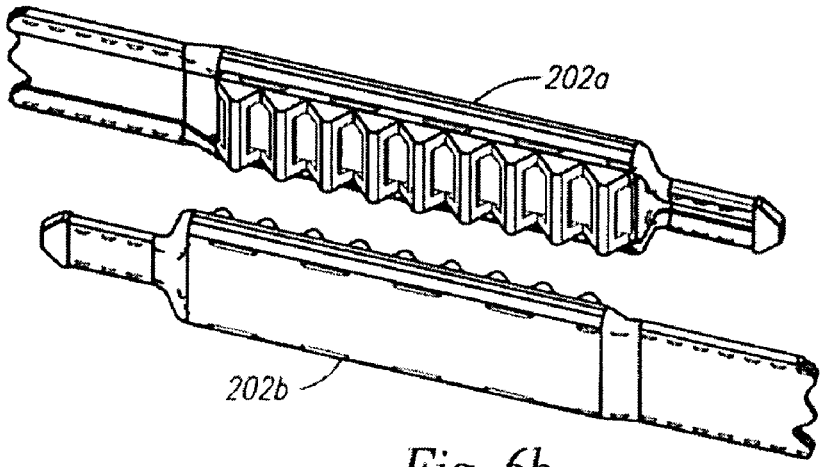
Figure 6C:
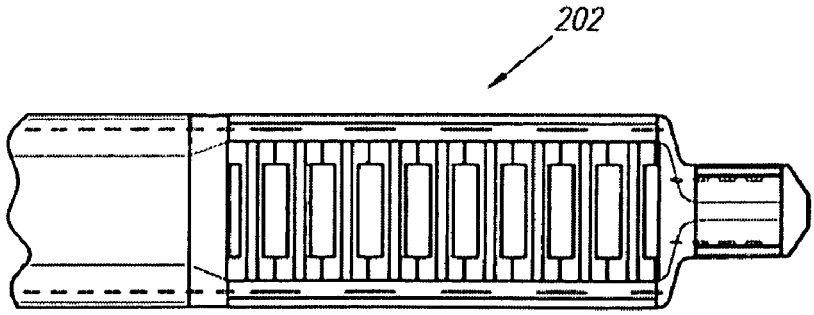
Figure 6D:
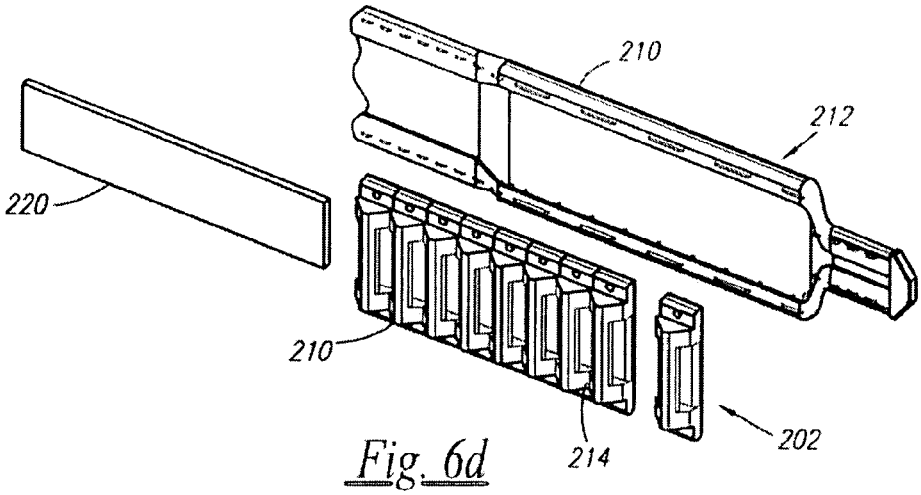
Figure 6E:
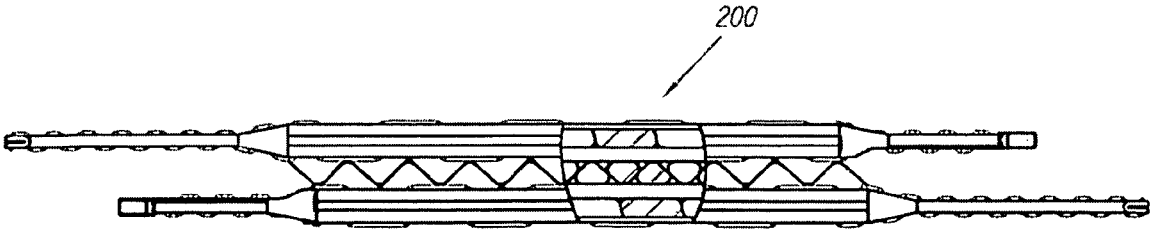

In operation, the present invention used in accordance with a preferred embodiment of the present invention, as shown in FIG. 5A through 5D, the reversible bra 10 can be rotated in and out about itself to allow for the outward display of alternate aesthetic designs. In making this transition, the clasp as shown in FIG. 5A must be removed, rotated and reattached. To accomplish this, either the upper or lower strap 14*a*, 14*b* is rotated 90° from the other as shown in FIG. 5B. The rotated D-ring, shown herein as the lower D-ring 112 is then pushed upward toward the clasp 100 as shown in FIG. 5C. Finally, the pivot pin 114 is then slid out and removed from the clasp 100. After rotated, the clasp 100 can be reassembled by reversing the above procedure.

The foregoing descriptions of specific embodiments of the present invention are presented for the purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and the embodiments with various modifications as are suited to the particular use contemplated. It is intended that a scope of the invention be defined by the Claims appended hereto and to their equivalents; the scope of the invention is to be limited only by the following claims.

The invention claimed is:

1. In a bra having a pair of cups, a pair of adjustable shoulder straps, one affixed to each said cup, and a connectable attachment band for circumscribing the torso of a user, said attachment band affixed to each said cup, and wherein the improvement comprises:

each said cup having a first fabric on a first side and a varying fabric on a reverse side;

each strap incorporates a pair of decorative pivoting clasps; and said attachment band further incorporating a decorative reversible latch.

2. The bra having a pair of cups, a pair of adjustable shoulder straps, and a connectable attachment band for circumscribing the torso of a user of claim 1, wherein said first fabric and said second fabric vary in either or both of color and aesthetic design.

3. The bra having a pair of cups, a pair of adjustable shoulder straps, and a connectable attachment band for circumscribing the torso of a user of claim 2, wherein said first fabric and said second fabric vary in material of construction.

4. The bra having a pair of cups, a pair of adjustable shoulder straps, and a connectable attachment band for circumscribing the torso of a user of claim 1, wherein each said pivoting clasp comprises:

a first D-ring connector attached to an upper strap element and having a first pivot pin extending downwardly from an apex of said connector's distal apex;

an annular clasp body formed of an outer first body half and an inner second body half, said clasp body mounting rotatably about said first pivot pin;

a second D-ring connector attached to a lower strap element and having a second pivot pin extending upward from an apex of the connector's distal apex; and said second pivot pin being removable from and rotatable relative to said strap.

5. The bra having a pair of cups, a pair of adjustable shoulder straps, and a connectable attachment band for circumscribing the torso of a user of claim 4, wherein said annular clasp body provides two separate aesthetic appearances and is formed of a pair of body halves that can be coordinated with a different color scheme.

6. The bra having a pair of cups, a pair of adjustable shoulder straps, and a connectable attachment band for circumscribing the torso of a user of claim 4, wherein said annular clasp body further comprises an aesthetic, a bead, gem or charm retained within an annular space formed by said clasp body.

7. The bra having a pair of cups, a pair of adjustable shoulder straps, and a connectable attachment band for circumscribing the torso of a user of claim 1, wherein said decorative reversible latch comprises:

an interlocking first latch half; and an interlocking second latch half;

wherein each latch half further comprises:

an aesthetic outer surface;

an interlocking attachment element on an inner surface, said attachment element being linearly elongated and forming a lateral series of detents; and a magnetic strip sandwiched between a fabric cover and attachment element.

8. The bra having a pair of cups, a pair of adjustable shoulder straps, and a connectable attachment band for circumscribing the torso of a user of claim 7, wherein said interlocking attachment element is symmetric facilitating interlocking fitment with each other.

9. The bra having a pair of cups, a pair of adjustable shoulder straps, and a connectable attachment band for circumscribing the torso of a user of claim 7, wherein the orientation of the direction of magnetic pole of the respective strips of said the first latch half and said second latch half are configured to magnetically attract and connect to one another.

* * * * *